US008181576B1

(12) United States Patent
Amato et al.

(10) Patent No.: US 8,181,576 B1
(45) Date of Patent: May 22, 2012

(54) PROJECTILE FOR STANDOFF DESTRUCTION OF EXPLOSIVE DEVICES

(75) Inventors: Brian T. Amato, Alexandria, VA (US); Steven Kim, Crofton, MD (US); Gerald Laib, Olney, MD (US); Carl Gotzmer, Accokeek, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 258 days.

(21) Appl. No.: 12/802,456

(22) Filed: May 14, 2010

(51) Int. Cl.
*F42B 12/20* (2006.01)

(52) U.S. Cl. ..... 102/499; 102/205; 102/396; 102/517

(58) Field of Classification Search ..... 102/202, 102/204, 205, 396, 397, 439, 499, 501, 517, 102/402, 403, 364
See application file for complete search history.

(56) References Cited

U.S. PATENT DOCUMENTS 3,677,181 A * 7/1972 Giljarhus et al. ..... 102/364
3,830,671 A * 8/1974 McArdle ..... 102/364
3,981,243 A * 9/1976 Doris, Jr. ..... 102/364
4,237,787 A * 12/1980 Wacula et al. ..... 102/364
4,876,964 A * 10/1989 Strandli et al. ..... 102/204
5,955,698 A 9/1999 Harkins et al.
5,988,038 A 11/1999 Feintuch
6,540,175 B1 4/2003 Mayersak et al.
6,691,622 B2 2/2004 Zavitsanos et al.
6,748,842 B1 6/2004 Guirguis

* cited by examiner

*Primary Examiner* — James Bergin
*Assistant Examiner* — Jonathan C Weber
(74) *Attorney, Agent, or Firm* — Fredric J. Zimmerman

(57) ABSTRACT

A projectile for safe standoff destruction of explosive devices. The projectile's casing encloses a chamber containing combustible material located opposite a roughened surface on the chamber. The combustible material is mounted so upon the projectile impacting the explosive device, the combustible material flies onto the roughened surface, heating the material by shear forces and igniting the material. This creates pressure bursting the chamber, injecting combustion gases into the explosive fill within the device, thereby igniting the fill locally at the impact, and along cracks in the fill. This arrangement prevents a coherent detonation wavefront from forming within the fill, and a slower burn of the fill, whereby a rifleman has little chance of receiving a concussive shock, or shrapnel, from the device.

17 Claims, 2 Drawing Sheets

PROJECTILE FOR STANDOFF DESTRUCTION OF EXPLOSIVE DEVICES

STATEMENT OF GOVERNMENT INTEREST

The invention described herein may be manufactured and used by or for the Government of the United States of America for governmental purposes without the payment of any royalties thereon or therefor.

FIELD OF THE INVENTION

The invention pertains to apparatus effective to remotely destroy, or otherwise render safe, explosive devices.

BACKGROUND OF THE INVENTION

Projectiles are known to be a convenient way to destroy explosive devices such as a mine or an Improvised Explosive Device (IED), for example a mine buried in the ground having an earthen overburden, a submerged mine under a water overburden, or a remotely detonated roadside bomb. By shooting a projectile such as a bullet or higher caliber round into the explosive device from a safe distance, one can initiate the explosive fill within the device and be rid of it. However, to destroy a device such as a land mine or IED, one must shoot at relatively close range. This situation exposes the rifleman to harm from the ignited device. Moreover, servicemen in the field can only carry so much equipment with them, so any projectile of practical use in the field must be reliably deployed using standard infantry weapons.

SUMMARY OF THE INVENTION

Accordingly, an object of the invention is to permit safe, standoff, destruction of explosive devices, such as, mines or improvised explosive devices.

Another object is to do the foregoing by use of a projectile fireable as a bullet generally from an infantry rifle.

In accordance with these and other objects made apparent hereinafter, it is an aspect of the invention to provide a projectile with an outer casing disposed about a space interior to the casing, and an inner surface that defines the space, a portion of which is given a preselected roughness. Disposed in the space is combustible material such that, responsive to impacting of the projectile after firing, the combustible material strikes against the roughened face. This arrangement permits, as the projectile penetrates into its targeted explosive device, the combustible material to shear against the roughened surface, thereby heating and igniting the combustible material, increasing pressure within, and bursting, the chamber. This arrangement injects hot combustion gases into the explosive fill of the explosive device locally at the point of projectile entry, and along cracks in the explosive fill. As a result, this invention prevents formation of a unitary ignition wavefront in the fill, and causes the fill to undergo reduced reaction, in effect burning (albeit rapidly) rather than exploding. Consequently, this technology prevents the explosive device from producing a large concussive shock, or generating enough explosive power to throw out shrapnel or other ballistic metal.

These and other objects are further understood from the following detailed description of exemplary embodiments of the invention. It is understood, however, that the invention is capable of extended application beyond the precise details of these embodiments. Changes and modifications may be made to the embodiments that do not affect the spirit of the invention, nor exceed its scope, as expressed in the appended claims. The embodiments are described with particular reference to the accompanying drawings, wherein:

Each of FIGS. 2 through 7 is a side elevational view, partly in section, of a respective exemplary embodiment of the invention.

DETAILED DESCRIPTION OF EXEMPLARY EMBODIMENTS OF THE INVENTION

Figure 1:
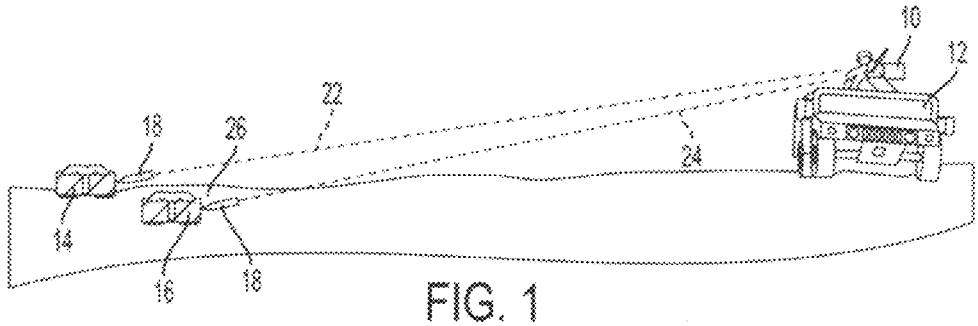
FIG. 1 is a plan view illustrating use of the invention.

With reference to the drawing figures, where like numbers indicate like parts throughout the several views, FIG. 1 shows explosive devices 14, 16, one of which (14) is above ground, the other of which (16) is below ground and covered by earthen over burden 26. For purposes of illustration, explosive device 14 is shown as an improvised explosive device, and object 16 as a buried land mine. Standing off a distance from explosive devices 14, 16 is rifleman 10 in transport 12 facing the devices along lines of sight 22, 24. As illustrated in FIG. 1, rifleman 10 fires projectiles 18 at objects 14, 16 with the intent of safely destroying objects 14 and 16, and by safely it is meant destroying the explosive fills in 14, 16 without exposing rifleman 10 to an explosive concussion or blow back of ballistic metal.

Figure 2:
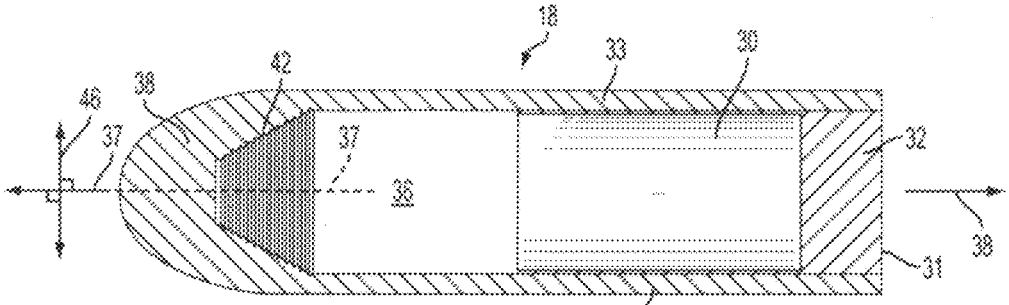

FIGS. 2 through 7 show embodiments of projectile 18 capable of producing this result. In FIG. 2, projectile 18 has an outer casing formed of forward portion 38 and rear portion 32 fit within elongate annular lip 33 of portion 38 to define a closed chamber 36 within projectile 18. Rear portion 32 has a face 31 on the outside of projectile 18, which, in conjunction with the rearward part of lip 33, forms a base for projectile 18, one can place in a launch platform, e.g., most notably a bullet cartridge. Members 32, 38 are attachable to one another in any conventional manner that one would use with ordnance. Located within chamber 36 adjacent member 32 is combustible material 30, disposed opposite a roughened surface 42 on the inner surface of chamber 36 along axial direction 37. Combustible material 30 is fixed in rear portion 32 generally by friction fitting, more particularly, in any manner that permits material 30 to slide out of lip 33 along axial direction 37 and impact upon roughened surface 42 of member upon impact of projectile 18 on a hard, object, such as, explosive devices 14 or 16. The roughening of surface 42 is in the form of grooves disposed axially opposite of combustible material 30, and projecting from casing portion 38 generally annularly (i.e. about axial direction 37 and generally parallel to radial direction 46).

In operation, rifleman 10 shoots projectile 18 at either explosive device 14 or 16 to render the device harmless. Earthen over burden 26 is far less dense and structurally harder compared to land mine 16, so the effect of projectile 18 on either land mine 18 or IED 16 is essentially the same. Upon impact, projectile 18 breaches the outer casing of the explosive device and penetrates into its explosive fill. The impact simultaneously dislodges combustible material 30 from annular lip 33, freeing combustible material 30 to fly by inertia forcibly into roughened surface 42. The grooves of surface 42, being annularly extending transverse to direction 37, exert shearing on combustible material 30 as the material strikes surface 42, heating material 30 and igniting it. As combustible material 30 burns, it rapidly fills chamber 36 with combustion gases, which burst projectile 18, thereby injecting hot gas into the portion of the explosive fill of 14 or 16 adjacent projectile 18's entry point, and along cracks in the explosive fill opened by projectile 18's impact. This sequence ignites the explosive fill locally and irregularly, as opposed to igniting the fill along a continuous wavefront. In this manner, projectile 18 induces a low order detonation that will cause the explosive fill of 14 or 16 to burn, rather than to undergo a high order detonation that could injure rifleman 10.

Combustible material 30 may be any appropriate fuel-oxidizer mix, for example, Department of Transportation Hazard Class 1.3, 1.4, or 4.1, but not Hazard Class 1.1. The roughness of surface 42 is, in an exemplary embodiment, about a 200 to about a 300 grit surface, with a higher roughness generally for less combustible fuel-oxidizer mixes, or mixes in powdered form, which will have little internal shearing to aid surface 42 to heat material 30. The fuel in material 30 may be, for example, aluminum, zirconium, titanium, or hafnium. Of these, aluminum has higher energy output and hence higher gas pressure in chamber 36, but is susceptible to oxidation. Hafnium is less given to oxidation, but produces less combustion energy and a correspondingly lower reaction pressure. Zirconium and titanium have exothermic and field stability properties between those of aluminum and hafnium. The oxidizer in combustible material 30 may be any chlorate or perchlorate, such as sodium, potassium or lithium chlorate. Fluorine compounds, such as aluminum fluoride, are also effective oxidizers, but have the disadvantage of producing highly toxic fluoride/fluorine compounds, notably the exceptionally caustic hydrogen fluoride. Generally, a .50 caliber bullet, or a 7.62 mm bullet (such as the M-14 rifle uses) will generate impact temperatures in excess of 1,500° F., easily sufficient to ignite these fuel-oxide mixes, so in general, all else being equal, the higher the ignition temperature of material 30 the better. Commercial explosives that are appropriate as material 30 include TNT, RX, RDX, HMX, and Composition B. Of these, TNT is more shock insensitive, and hence more stable in the field, in comparison to RDX and HMX, which are relatively more shock and friction sensitive to detonation. Composition B is more sensitive to impact.

Figure 3:
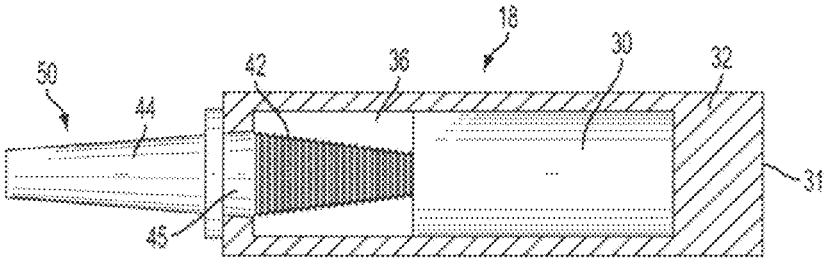

FIG. 3 shows another embodiment of projectile 18 in which rear portion 32 extends the entire length of chamber 36, and contains an opening in which nose member 50 resides, which includes outwardly facing portion 44, central portion 45 fixedly mounted in rear portion 32, and an inwardly facing (i.e. towards chamber 36) protuberance, which carries roughened surface 42. Together, rear portion 32 and nose member 50 constitute the outer casing of projectile 18, and enclose and define inner combustion chamber 36. The inwardly facing protuberance is a conical shaped needle which, upon impact of projectile 18 on explosive device 14 or 18, stabs into material 30 over a relatively small surface area, causing initial-penetration. Thereafter, as penetration progresses, the increasing size over which surface 24 lies shears material 30 over an increasing surface area. This arrangement permits reliable initial penetration into a relatively hard form of combustant 30, and thereafter ramps up the shear heating of material 30 for rapid burning. Outwardly facing portion 44 may be conical, or dart, shaped, as shown in FIG. 3 in order to penetrate especially hardened targets.

Figure 4:
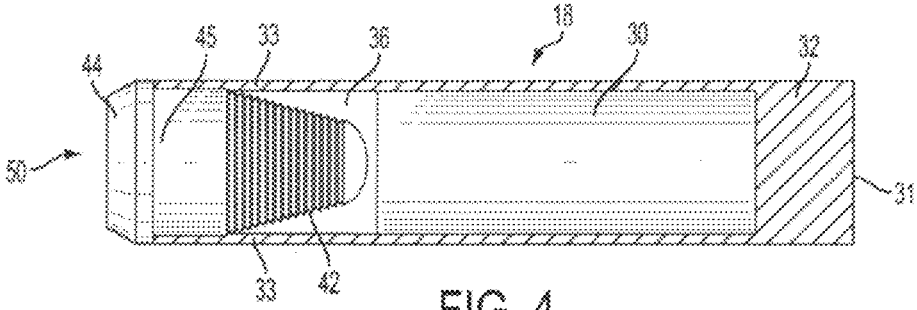

FIG. 4 shows an embodiment similar to that of FIG. 3, but in which nose member 50 is broad, having an outwardly extending face 44 that is flat, and a roughened surface 42 distributed over a correspondingly broad and rounded inwardly facing protuberance, and a central portion 45 therebetween. Broadened face 44 and central portion 45 have annular cross sections substantially the same as combustible material 30, which causes target impact over a wider area, and hence ignite the target's explosive fill over a wider area, but has less initial penetrating force. (By annular cross section it is meant the plane spanned by radial direction 46, and the direction mutually perpendicular to directions 37, 46.) In this embodiment, rear portion 32 and lip 33 are unitary.

Figure 5:
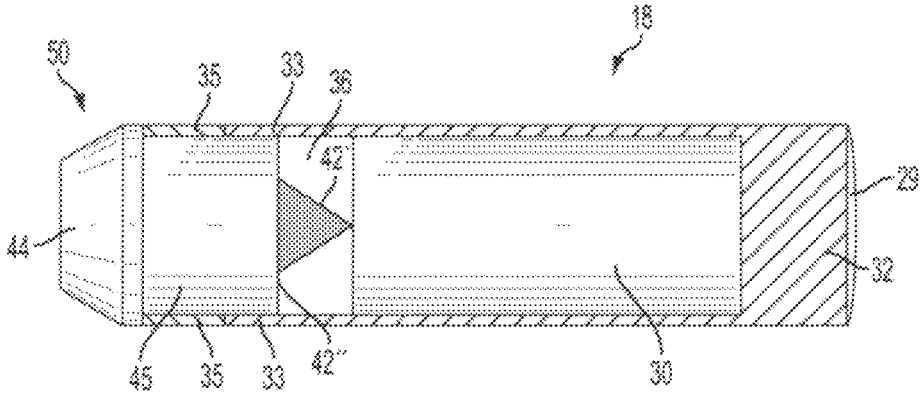

FIG. 5 shows an embodiment similar to that of FIG. 4, but with an annular ring 35 disposed between nose member 50 and annular lip 33, and with optional backing 29. Members 32, 33 are here again unitary. Ring 35 is of material more malleable than that of casing 32, 33, 50, e.g. of copper as opposed to the brass commonly used in bullet casings. Roughened surface 42 has a pointed raised portion 42' extending inwardly towards combustible material 30, and a flat portion 42" axially opposite material 30. Upon impact of face 44 on a target, backward movement of central portion 45 of nose 50" crushes ring 35, accelerating roughened surface 42', 42" towards combustible material 30, while material accelerates towards 42', 42" by inertia as in the above described embodiments. This configuration increases the relative velocity between the roughened surface and combustible material, and hence the energy available to ignite material 30. Pointed raised portion 42' stabs into material 30 similarly to the embodiment of FIG. 3, and flat roughened surface 42" ensures shearing of material 30 over a wide surface area after the crushing of ring 35 forces the nose member 50 and material 30 together.

Figure 6:
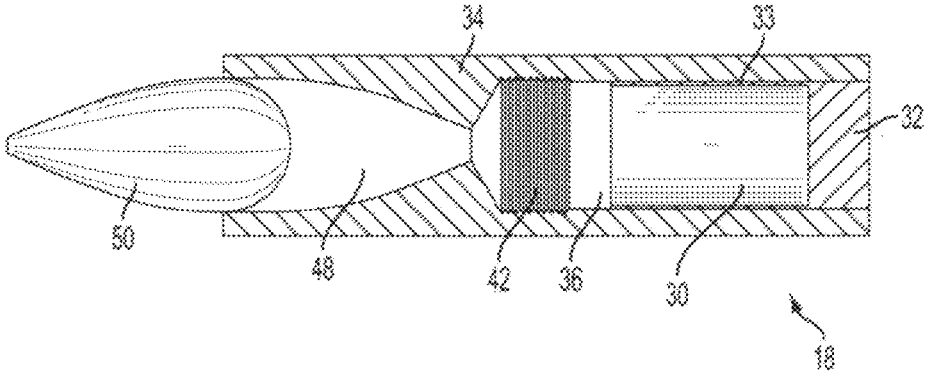

FIG. 6 shows an embodiment in which chamber 36 has an additional volume 48 disposed axially forward of roughened surface 42 and axially rearward of nose member 50. Rear portion 32 and outer casing 34 nest with nose member 50 to define chamber 36. In this embodiment, rear portion 32 has an annular lip 33 that extends axially into chamber 36 and holds combustible material 30. Nose member 50 is of a readily deformable material such as copper, so that the striking of nose member 50 against a target deformably forces member 50 into volume 48 and compresses gas inside chamber 36 adiabatically. This configuration increases the heat available in chamber 36 over that generated by combustible material 30 impacting roughened surface 42, aiding the ignition and burning of material 30. Generally, volume 48 is smaller than that of nose slug 50 so that, upon impact, the pressure in chamber 36 spikes rapidly. With this scheme, one can readily generate temperatures above 1,000° F., and upwards of 2,500° F., which is quite adequate for, e.g., hafnium ignition.

Figure 7:
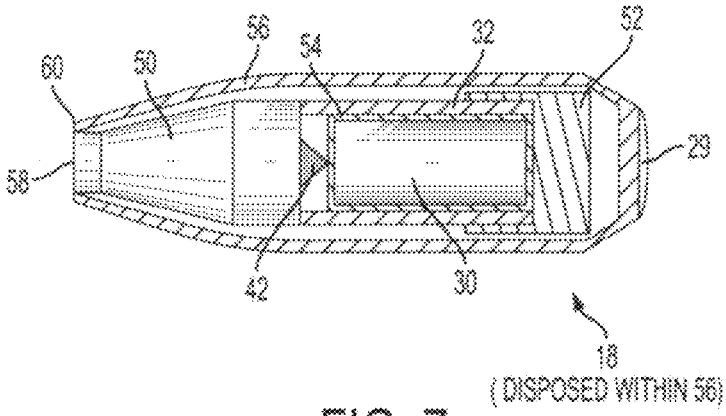

FIG. 7 shows an embodiment in which an outer casing 56 surrounds a projectile 18 of the general kind above described. Encapsulant 54 encases combustible material 30, which, is necessary if material 30 is sufficiently powdery or crumbly to require containment. Encapsulant 54 also protects against oxidation of material 30, as well as accidental ignition when loading material 30 into projectile 18. Encapsulant 54 should be sufficiently thin so that it is in practical effect mechanically transparent to the cone having roughened surface 42 during impact. One can use encapsulant 54 in this manner with any other embodiment of the invention, where conditions suggest a need for it. Outer casing 56 is of a relatively soft and deformable material, such as copper, and encloses a mass 52, of exemplary materials, such as, tungsten, lead, or other dense metal, which give the projectile more inertia, and hence more penetration power. Within mass 52 is rear member 32, in which is located combustible material 30. Outer casing 56 also has backing 29 to protect the relatively soft material of 56 from cartridge gases. Outer casing 56 has opening 60, which receives outer face 58 of projectile 18's nose portion 50. Opening 60 fits flush against face 58, so outer casing 56 and face 58 have no gap, which air could grab a hold of, to disturb the trajectory of projectile 18. The dimensions of flat nose face 58 are chosen so that, in flight, the combined projectile 18 and outer casing 56 will create a supercavitating wavefront ahead of face 58 and extending about outer casing 56. Being surrounded by the supercavitation wavefront, projectile 18, 56 is more resistant to veering off course, or tumbling. This technology is particularly important for a buried or submerged target, whose over burden such as 26 (FIG. 1) will tend to deflect an incoming projectile, and against which a supercavitating wavefront about projectile 18, 56 will mitigate. The generation of supercavitation surfaces per se is known, and in general the larger the diameter of surface 58 is compared to that of mass 52, the larger will be the supercavitating air pocket surrounding outer casing 56, and the lower the drag on casing 56 induced by supercavitation. An effective ratio between the diameters of 58 to 52 may be about one to about two. Upon striking a target such as 14, 16, the impact may strip soft casing 56 from inner projectile 18, and projectile 18 will penetrate the target, and thereafter operate as in the above described embodiments.

The invention has been described in what is considered to be various exemplary embodiments. It is recognized, however, that obvious modifications to these embodiments may occur to those with skill in this art. For example, from the foregoing, one can see that parts from each of the above described embodiments may be used together advantageously with those of other embodiments; and that although the foregoing discusses projectiles in the form of rifle bullets, the invention is useful with any ordnance system that can deliver the projectile with sufficiently modest energy to ensure that the projectile will not kinetically detonate a targeted explosive fill. Finally, any numerical parameters set forth in the specification and attached claims are approximations (for example, by using the term about) that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

We claim:

1. A projectile, comprising:

an outer casing being disposed about a space interior to said casing, said casing comprises an inner surface to define said space, a portion of said inner surface is a roughened face of preselected roughness; and a combustible material being disposed in said space, wherein said combustible material is disposed effective to cause, responsive to impacting of said projectile after firing of said projectile, the striking of said combustible material against said roughened face to cause ignition of said combustible material.

2. The projectile of claim 1, wherein said space extends substantially axially along said casing, wherein said roughened face and said combustible material are disposed axially opposite of one another in said space, and wherein said combustible material is disposed within said space effective to permit the axial sliding of said combustible material along said space responsive to said impacting, effective to cause said striking of said combustible material against said roughened face.

3. The projectile of claim 2, wherein said preselected roughness is effective to cause shearing of said combustible material upon said striking of said combustible material against said roughened face.

4. The projectile of claim 2, wherein said preselected roughness is effective to cause shearing of said combustible material upon said striking of said combustible material against said roughened face, and wherein said preselected roughness and said combustible material are selected effective to cause ignition of said combustible material responsive to said shearing.

5. The projectile of claim 2, wherein said preselected roughness is effective to cause shearing of said combustible material upon said striking of said combustible material against said roughened face, and wherein said combustible material is friction fit in said casing effective to permit said axial sliding of said material responsive to said impacting.

6. The projectile of claim 2, wherein said preselected roughness is effective to cause shearing of said combustible material upon said striking of said combustible material against said roughened face, wherein said casing comprises an annular lip to define an opening and a nose member disposed in said opening effective to close said casing, wherein said nose member comprises an external face, which extends out of said space, and a protuberance, which extends into said space, and wherein said roughened face is disposed on said protuberance.

7. The projectile of claim 2, wherein said preselected roughness is effective to cause shearing of said combustible material upon said striking of said combustible material against said roughened face, wherein said casing comprises an annular lip to define an opening and a nose member disposed in said opening effective to close said casing, wherein said nose member comprises an external face, which extends out of said space, and a protuberance, which extends into said space, wherein said roughened face is disposed on said protuberance, and wherein said protuberance is a substantially conical shaped needle structure disposed to effect said striking of said combustible material by stabbing into said combustible material responsive to said impacting.

8. The projectile of claim 2, wherein said preselected roughness is effective to cause shearing of said combustible material upon said striking of said combustible material against said roughened face, wherein said casing comprises an annular lip to define an opening and a nose member disposed in said opening effective to close said casing, wherein said nose member comprises an external face, which extends out of said space, and a protuberance, which extends into said space, wherein said roughened face is disposed on said protuberance, and wherein said protuberance comprises an annular cross-section substantially a same radial size as that of said combustible material effective to cause crushing of said combustible material against said roughened face responsive to said striking.

9. The projectile of claim 2, wherein said preselected roughness is effective to cause shearing of said combustible material upon said striking of said combustible material against said roughened face, wherein said casing comprises an annular lip to define an opening and a nose member disposed in said opening effective to close said casing, wherein said nose member comprises an external face, which extends out of said space, and a protuberance, which extends into said space, wherein said roughened face is disposed on said protuberance, and wherein said roughened face includes a pointed raised portion.

10. The projectile of claim 2, wherein said preselected roughness is effective to cause shearing of said combustible material upon said striking of said combustible material against said roughened face, wherein said casing comprises an annular lip to define an opening and a nose member disposed in said opening effective to close said casing, wherein said nose member comprises an external face, which extends out of said space, and a protuberance, which extends into said space, wherein said roughened face is disposed on said protuberance, and wherein said nose member is disposed, responsive to said impacting, to displace into said chamber effective to increase the pressure and temperature within said chamber upon said impacting.

11. The projectile of claim 2, wherein said preselected roughness is effective to cause shearing of said combustible material upon said striking of said combustible material against said roughened face, wherein said casing comprises an annular lip to define an opening and a nose member disposed in said opening effective to close said casing, wherein said nose member comprises an external face, which extends out of said space, and a protuberance, which extends into said space, wherein said roughened face is disposed on said protuberance, wherein said casing is an inner casing, wherein said projectile comprises an additional casing disposed annularly about said inner casing, said additional casing includes an opening disposed about said nose member, and wherein said external face of said nose member is selected to cause supercavitation of said projectile.

12. The projectile of claim 2, further comprising an inertial mass, wherein said preselected roughness is effective to cause shearing of said combustible material upon said striking of said combustible material against said roughened face, wherein said casing comprises an annular lip to define an opening and a nose member disposed in said opening effective to close said casing, wherein said nose member comprises an external face, which extends out of said space, and a protuberance, which extends into said space, wherein said roughened face is disposed on said protuberance, wherein said casing is an inner casing, wherein said projectile comprises an additional casing disposed annularly about said inner casing, said additional casing includes an opening disposed about said nose member, wherein said external face of said nose member is selected to cause supercavitation of said projectile, and wherein said inertial mass is disposed axially opposite of said nose member.

13. The projectile of claim 2, further comprising an inertial mass, wherein said preselected roughness is effective to cause shearing of said combustible material upon said striking of said combustible material against said roughened face, wherein said casing comprises an annular lip to define an opening and a nose member disposed in said opening effective to close said casing, wherein said nose member comprises an external face, which extends out of said space, and a protuberance, which extends into said space, wherein said roughened face is disposed on said protuberance, wherein said casing is an inner casing, wherein said projectile comprises an additional casing disposed annularly about said inner casing, said additional casing includes an opening disposed about said nose member, wherein said external face of said nose member is selected to cause supercavitation of said projectile, wherein said inertial mass is disposed axially opposite of said nose member, wherein said external face of said nose member is an annular face, and wherein the ratio of the diameter of said annular face of said nose member, to the diameter of said annular mass, is about 0.5.

14. The projectile of claim 2, further comprising an inertial mass, wherein said preselected roughness is effective to cause shearing of said combustible material upon said striking of said combustible material against said roughened face, wherein said casing comprises an annular lip to define an opening and a nose member disposed in said opening effective to close said casing, wherein said nose member comprises an external face, which extends out of said space, and a protuberance, which extends into said space, wherein said roughened face is disposed on said protuberance, wherein said casing is an inner casing, wherein said projectile comprises an additional casing disposed annularly about said inner casing, said additional casing includes an opening disposed about said nose member, wherein said external face of said nose member is selected to cause supercavitation of said projectile, wherein said inertial mass is disposed axially opposite of said nose member, wherein a predominant material constituent of said inertial mass is selected from the group consisting of lead and tungsten, and wherein the predominant material constituent of said outer casing is copper.

15. The projectile of claim 2, further comprising an inertial mass, wherein said preselected roughness is effective to cause shearing of said combustible material upon said striking of said combustible material against said roughened face, wherein said casing comprises an annular lip to define an opening and a nose member disposed in said opening effective to close said casing, wherein said nose member comprises an external face, which extends out of said space, and a protuberance, which extends into said space, wherein said roughened face is disposed on said protuberance, wherein said casing is an inner casing, wherein said projectile comprises an additional casing disposed annularly about said inner casing, said additional casing includes an opening disposed about said nose member, wherein said external face of said nose member is selected to cause supercavitation of said projectile, wherein said inertial mass is disposed axially opposite of said nose member, wherein said casing comprises a nose member; an annular body member, which includes an annular lip to define an annular opening; and an annular ring disposed axially between said annular lip and said nose member, wherein said nose member, said annular ring, and said annular body member are axially disposed effective to close said casing about said space, wherein said nose member comprises an external face, which extends out of said space, and a protuberance, which extends into said space, said roughened face is disposed on said protuberance, and wherein said annular ring comprises a preselected malleability sufficient to permit said annular ring to be crushed between said nose member and said annular lip responsive to said impacting, effective to increase the force of said striking of said combustible material against said roughened face.

16. The projectile of claim 1, wherein said preselected roughness is effective to cause shearing of said combustible material upon said striking of said combustible material against said roughened face, wherein said preselected roughness and said combustible material are selected effective to cause ignition of said combustible material responsive to said shearing, and wherein said roughened face comprises grooves disposed radially transverse to the axial length of said casing.

17. The projectile of claim 16, wherein said combustible material is friction fit in said casing effective to permit said axial sliding of said material responsive to said impacting.

* * * * *